US008506193B1

(12) United States Patent
Zhang

(10) Patent No.: US 8,506,193 B1
(45) Date of Patent: Aug. 13, 2013

(54) COSMETIC FLUID DISPENSER

(75) Inventor: Derik Zhang, Dongguan (CN)

(73) Assignee: Lava Industries, Inc., El Monte, CA (US)

( * ) Notice: Subject to any disclaimer, the term of this patent is extended or adjusted under 35 U.S.C. 154(b) by 699 days.

(21) Appl. No.: 12/661,814

(22) Filed: Mar. 25, 2010

(51) Int. Cl.
*B05C 17/01* (2006.01)
*B43K 5/06* (2006.01)

(52) U.S. Cl.
USPC ..... 401/175; 401/154; 401/164; 401/171; 222/110; 222/380; 222/402.14

(58) Field of Classification Search
USPC ..... 401/171, 172, 173, 175, 176, 177
See application file for complete search history.

(56) References Cited

U.S. PATENT DOCUMENTS

| | | | | |
|---|---|---|---|---|
| 1,936,822 | A | 11/1933 | Boenecke | |
| 1,965,690 | A | 7/1934 | Creveling | |
| 1,971,127 | A | 8/1934 | Arnold et al. | |
| 2,029,055 | A | 1/1936 | Burke | |
| 2,123,741 | A | 7/1938 | Newton | |
| 2,163,974 | A | 6/1939 | Blett | |
| 2,487,642 | A | 11/1949 | Waltoff | |
| 2,587,794 | A | 3/1952 | Walker et al. | |
| 2,799,881 | A | 7/1957 | Howe | |
| 3,420,417 | A | 1/1969 | Kardel | |
| 3,807,881 | A | 4/1974 | Seidler | |
| 4,071,300 | A | 1/1978 | Nichols et al. | |
| 5,025,960 | A | 6/1991 | Seager | |
| 6,386,781 | B1 | 5/2002 | Gueret | |
| 6,964,357 | B2 | 11/2005 | Manganini | |
| 7,300,221 | B2 | 11/2007 | Byun | |
| 2005/0111901 | A1 * | 5/2005 | Tintore Belil | 401/176 |
| 2009/0016805 | A1 | 1/2009 | Byun | |
| 2009/0297252 | A1 | 12/2009 | Prague | |

* cited by examiner

*Primary Examiner* — David Walczak
*Assistant Examiner* — Joshua Wiljanen
(74) *Attorney, Agent, or Firm* — William W. Haefliger

(57) ABSTRACT

A cosmetic fluid dispenser, comprising in combination a vertically elongated housing structure containing upper and lower compartments, the lower compartment configured to receive and store cosmetic fluid; a dispenser tube projecting vertically from the lower interior of the lower compartment, upwardly into the upper compartment; a plunger movable vertically in the housing, the housing structure including a rotor rotatable to drive the plunger downwardly for effecting fluid displacement into and upwardly in the dispenser tube; and a valve for preventing inadvertent leakage of fluid from the tube, and characterized as openable in response to use of the dispenser.

14 Claims, 4 Drawing Sheets

COSMETIC FLUID DISPENSER

BACKGROUND OF THE INVENTION

This invention relates generally to dispensing of cosmetic fluid, and more particularly to controlled and metered dispensing of such fluid.

There is need for means to control and thereby conserve cosmetic fluid use and dispensing, and also, to enable controlled metering dispensing by means of apparatus that is easily usable and storable in readily dispensing mode, for simple, reliable instant use.

SUMMARY OF THE INVENTION

It is a major object of the invention to provide an improved and preferred cosmetic fluid dispenser meeting the above need. Basically, the dispenser comprises a) a vertically elongated housing structure containing upper and lower compartments, the lower compartment configured to receive and store cosmetic fluid, b) a dispenser tube projecting vertically from the lower interior of the lower compartment, upwardly into the upper compartment, c) a plunger movable vertically in the housing, d) the housing structure including a rotor rotatable to drive the plunger downwardly for effecting fluid displacement into and upwardly in the dispenser tube, e) and a valve for preventing inadvertent leakage of fluid from the tube, and characterized as automatically openable during use of the dispenser.

Another object is to provide screw threading operatively interconnecting the rotor and said plunger, to convert rotary motion of the rotor into vertical motion of the plunger.

A further object is to provide housing structure including coaxial upper and lower cylindrical structures, the upper cylindrical structure including a cap removably closing uppermost open extent of the lower cylindrical structure, which is removable to enable filling of cosmetic fluid into that lower cylindrical structure.

Yet another object includes locating the valve in the upper cylindrical structure and exposed for pressure operation to control dispensing of fluid. As will be seen, the valve has operative communication with fluid being dispensed via a wick; and the valve preferably has in-line communication with the tube. The valve may be responsive to finger pressure exerted on the rotor.

An added object is to provide a dispenser wick at the uppermost end of the housing structure, and in direct communication with the valve. The wick typically extends downwardly into the upper cylindrical structure to communicate with the upper end of the dispenser tube.

Another object is to provide the plunger with a lower guide flange extending adjacent a cylindrical wall of the housing, and an inner flange extending adjacent the tube and having threaded engagement therewith. As will be seen, the two flanges preferably have local flexible interconnection, minimizing resistance to plunger travel along the threaded tube, in the housing.

These and other objects and advantages of the invention, as well as the details of an illustrative embodiment, will be more fully understood from the following specification and drawings, in which:

DRAWING DESCRIPTION

FIG. 1 is a vertical section showing assembly of the preferred dispenser components;

FIG. 1*a* is an enlarged view of plunger components seen in FIG. 1;

DETAILED DESCRIPTION

Figure 1:
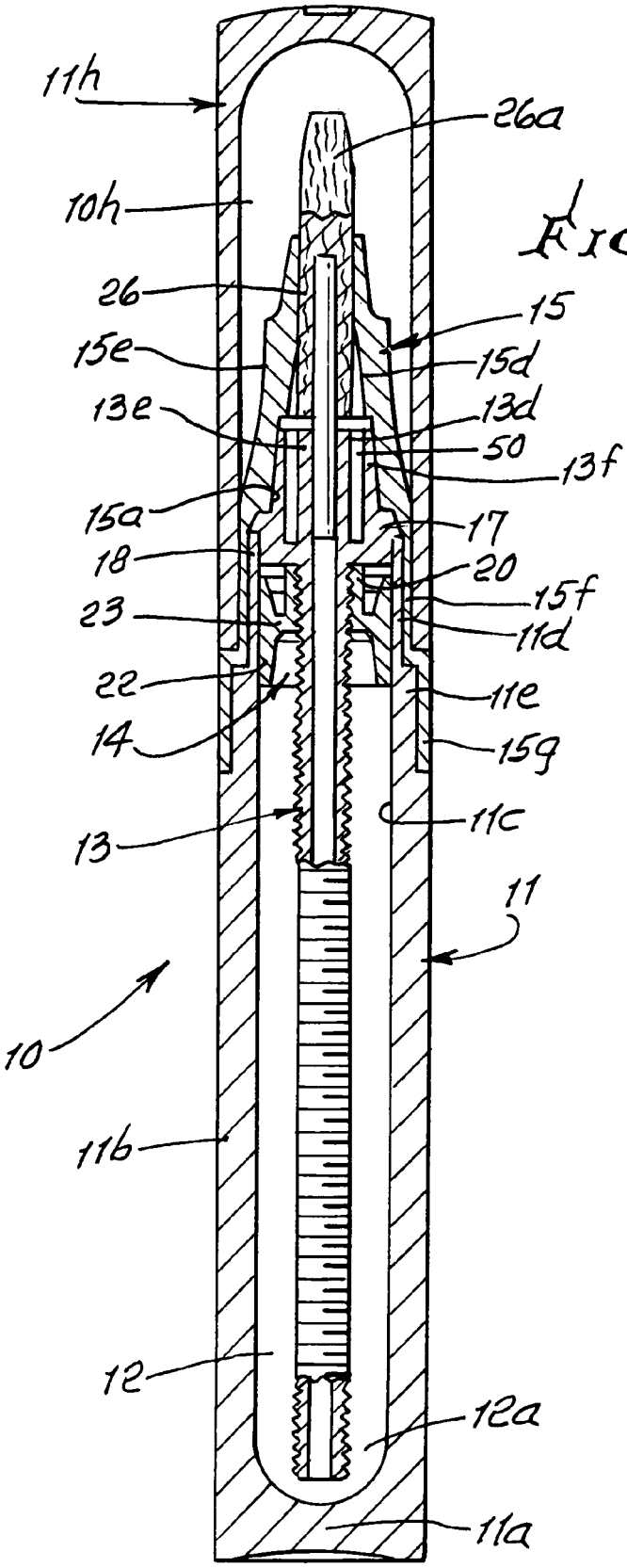
Figure 1A:
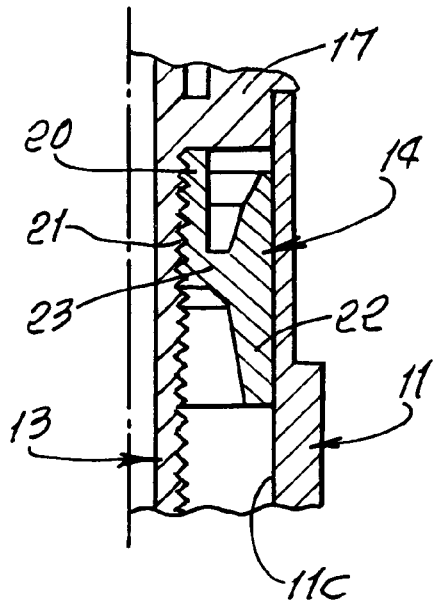
Figure 2:
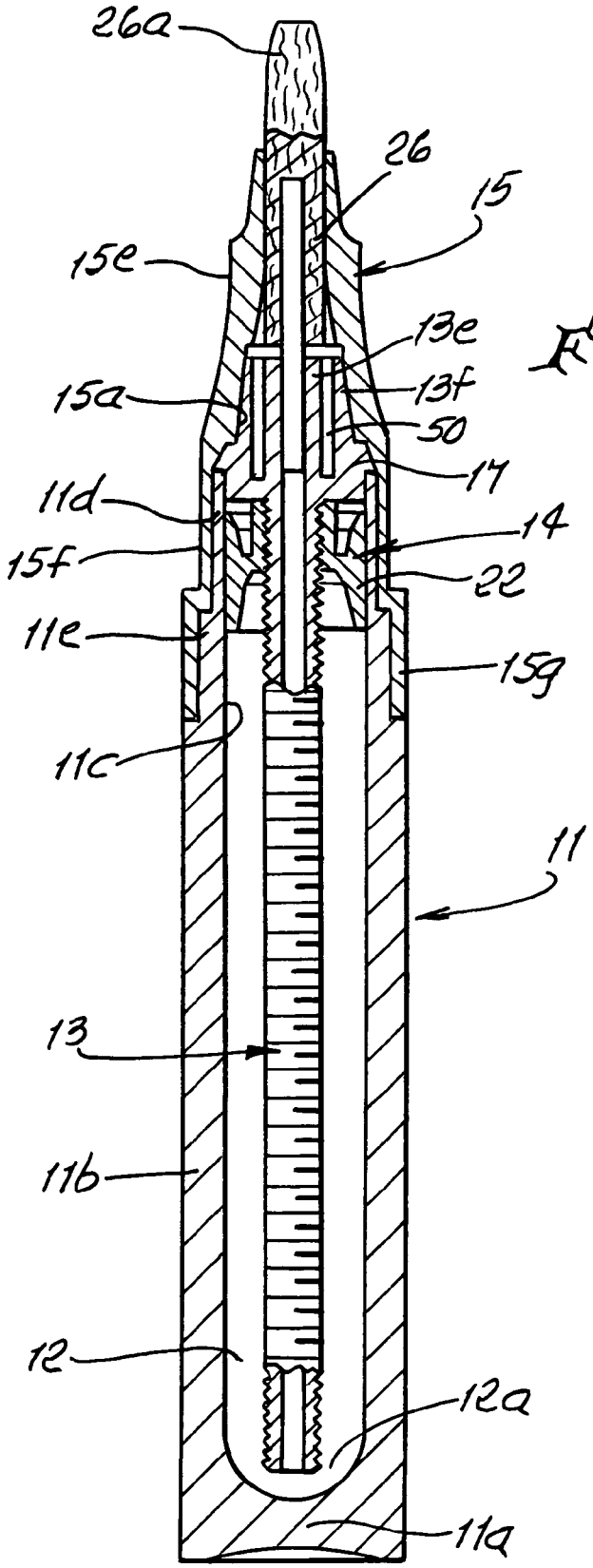
FIG. 2 is a view like FIG. 1, but with the housing cap removed.

In FIG. 1, a vertically elongated housing 10 includes an upright cylinder 11 having a closed lower end 11*a*, and an upright cylindrical wall 11*b* defining a vertical cylindrical bore guide surface 11*c*. A fluid dispenser tube 13 projects vertically and centrally upward, from the lower interior 12*a* of a lower compartment 12 defined by cylinder 11. That lower interior 12*a* is configured to receive and store cosmetic fluid to be dispensed. Examples are lotion, mascara and lip gloss, others being usable and initially filling compartment 12 up to the lower side location of a plunger 14.

Plunger 14 is movable vertically in the housing, as for example downwardly, in response to manual rotation of a rotor 15. Such rotation is transmitted to the tube by connection of the rotor to the tube; see for example the enlarged annular head 17 integral with the tube, and joined at 18 to the bore 15*a* of the rotor. Plunger 14 has a flange 20 that threadably engages tube threading at 21, whereby as the tube is rotated, the plunger travels downwardly. The plunger also has outer flange 22 of substantial length, and relatively reduced thickness, allowing it to frictionally yet axially slidably engage the bore 11*c*, whereby the plunger is restrained from rotation, yet is not restrained from axial travel. Also, the two flanges are flexibly interconnected at annular web 23 allowing flange 22 to flex and maintain its frictional yet axially slidable engagement with bore 11*c*, as the plunger travels axially downwardly in the bore, pushing fluid contents up the interior of the tube, for dispensing discharge.

Tube 13 extends upwardly to terminate at 13*d* within the upper tapered extent 15*d* of rotor 15, and within or adjacent a wick or brush 26 that projects upwardly from within 15*d*, to freely extend at 26*a* for fluid dispensing. The rotor has an axially elongated, outwardly facing concave side 15*e*, for ease of finger engagement just below the wick, enabling ease of rotor rotation, and fluid dispensing, with the wick applied to the user's face, as during make-up.

Rotor sleeves 15*f* and 15*a* slidably fit over upper extents 11*d* and 11*e* of the cylindrical housing, for guiding rotor rotation. Tube 13 upper extent 13*e* is radially spaced at 50 from tube upper extent 13*f* attached to the rotor, preventing pinching of 13*e* as the rotor is grasped and turned.

Figure 5:
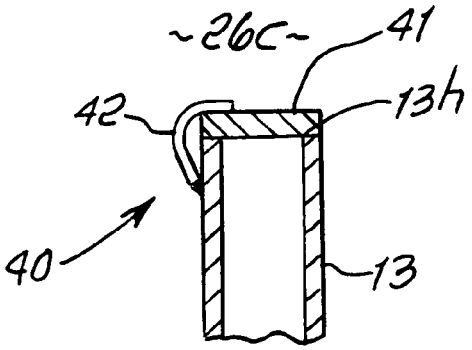
FIG. 5 is an enlarged fragmentary view, showing provision of a valve in association with the dispenser tube.
Figure 6:
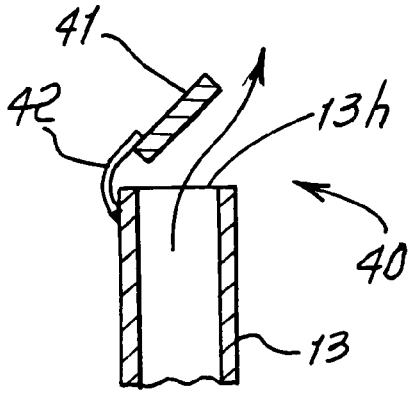
FIG. 6 is like FIG. 5, but showing the valve in open position to allow flow of fluid from the dispenser.

An added feature is the provision of a valve for preventing inadvertent leakage of fluid from the tube, as for example into the housing cap 11*h* and into the housing upper interior compartment 10*h*. FIG. 5 shows one such valve 40, having a stopper 41 carried at the tube 13 upper end, as by a spring hinge 42, in valve closed position, extending and urged adjacent the tube upper end 13*h*, to close off fluid leakage. During use of the dispenser, the process of fluid being dispensed lifts the stopper to FIG. 6 position, enabling flow onto the wick. Zone 26*c* nearest the valve is hollow, and allows opening of the stopper.

Figure 3:
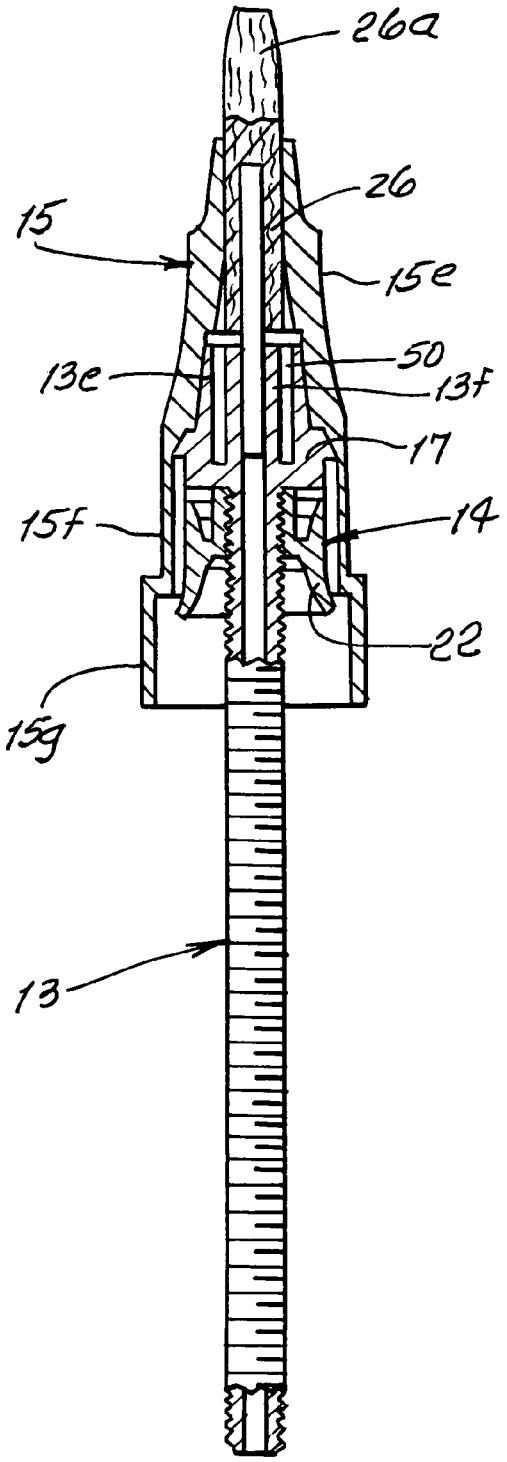
FIG. 3 is a view like FIG. 2, but with the outer housing entirely removed.
Figure 4:
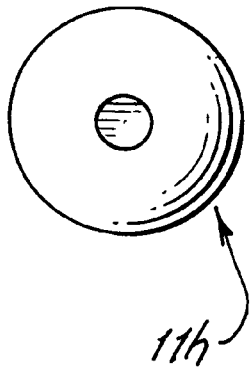
FIG. 4 is an end view of the FIG. 1 dispenser.

The cap 11*h* closes uppermost open extent of the lower cylindrical structure, which is removable to enable filling of cosmetic fluid into said lower cylindrical structure. See FIG. 3.

Figure 7:
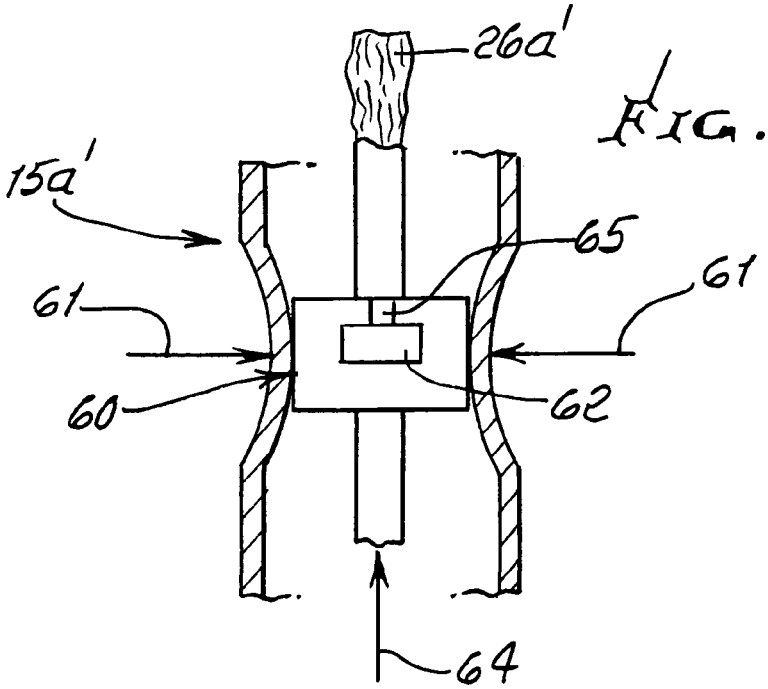
FIG. 7 shows a valve openable in response to grasping of the fluid dispensing rotor for rotation.

FIG. 7 diagrammatically shows a finger pressure responsive valve 60 associated with rotor 15*a*' (like rotor 15). As rotor 15*a*' is finger gripped (see arrows 61) during rotor turning, as in FIG. 1, the valve is squeezed and a stopper 62 is displaced away from seat, opening the valve to allow fluid in the tube to flow upward at 64 and through orifice at 65, to and through the dispenser 26*a*'. Thus, rotor 15*a*' serves multiple functions.

What is claimed is:

1. A cosmetic fluid dispenser, comprising in combination:

a) a vertically elongated housing structure containing upper and lower compartments, the lower compartment configured to receive and store cosmetic fluid, b) a dispenser tube projecting vertically from the lower interior of the lower compartment, upwardly into the upper compartment, c) a plunger movable vertically in the housing, d) the housing structure including a rotor rotatable to drive the plunger downwardly for effecting fluid displacement into and upwardly in the dispenser tube, e) and a valve for preventing inadvertent leakage of fluid from the tube, and characterized as openable in response to use of the dispenser f) the valve being connected to the rotor to open in response to finger pressure communicated to the rotor, pushing rotor structure toward the valve in series with the tube.

2. The combination of claim 1 including screw threading operatively interconnecting the rotor and said plunger, to convert rotary motion of the rotor into vertical motion of the plunger.

3. The combination of claim 1 wherein the housing structure is generally cylindrical.

4. The combination of claim 1 wherein the housing structure includes coaxial upper and lower cylindrical structures, the upper cylindrical structure including a cap removably closing uppermost open extent of the lower cylindrical structure, which is removable to enable filling of cosmetic fluid into said lower cylindrical structure.

5. The combination of claim 1 including a dispenser wick at the uppermost end of said housing structure, and in direct communication with the valve.

6. The combination of claim 4 including a dispenser wick at the uppermost end of said upper cylindrical structure.

7. The combination of claim 6 wherein the wick extends downwardly into said upper cylindrical structure to communicate with the upper end of the dispenser tube.

8. The combination of claim 4 wherein said valve is located in said upper cylindrical structure and exposed for fluid pressure operation to control dispensing of said fluid.

9. The combination of claim 7 wherein the valve has operative communication with fluid being dispensed via the wick.

10. The combination of claim 1 wherein the plunger has an outer annular guide flange extending adjacent a cylindrical wall of the housing, and an inner flange extending adjacent the tube and having threaded engagement therewith.

11. The combination of claim 10 wherein the two flanges have local flexible interconnection, allowing the outer flange to frictionally yet slidably engage the housing bore.

12. A cosmetic fluid dispenser, comprising in combination:

a) a vertically elongated housing structure containing upper and lower compartments, the lower compartment configured to receive and store cosmetic fluid, b) a dispenser tube projecting vertically from the lower interior of the lower compartment, upwardly into the upper compartment, c) a plunger movable vertically in the housing, d) the housing structure including a rotor rotatable to drive the plunger downwardly for effecting fluid displacement into and upwardly in the dispenser tube, e) the plunger having a lower annular guide flange extending adjacent a cylindrical wall of the housing, and an inner flange extending adjacent the tube and having threaded engagement therewith, f) wherein the two flanges have local flexible interconnection, allowing the outer flange to frictionally yet slidably engage the housing bore, g) a valve for preventing inadvertent leakage of fluid from the tube, and characterized as openable in response to the use of the dispenser, h) the valve being connected to the rotor to open in response to finger pressure communicated to the rotor, pushing rotor structure toward the valve in series with the tube.

13. The combination of claim 1, wherein the valve is located to open as the rotor is grasped, for rotation.

14. A cosmetic fluid dispenser, comprising in combination:

a) a vertically elongated housing structure containing upper and lower compartments, the lower compartment configured to receive and store cosmetic fluid, b) a dispenser tube projecting vertically from the lower interior of the lower compartment, upwardly into the upper compartment, c) a plunger movable vertically in the housing, d) the housing structure including a rotor rotatable to drive the plunger downwardly for effecting fluid displacement into and upwardly in the dispenser tube, e) screw threading operatively interconnecting the rotor and said plunger, to convert rotary motion of the motor into vertical motion of the plunger, f) a valve for preventing inadvertent leakage of fluid from the tube, and characterized as openable in response to the use of the dispenser, g) the valve being connected to the rotor to open in response to finger pressure communicated to the rotor, pushing rotor structure toward the valve in series with the tube.

* * * * *